US005460555A

United States Patent [19]

Fukuoka et al.

[11] Patent Number: 5,460,555

[45] Date of Patent: Oct. 24, 1995

[54] OIL SUPPLY SYSTEM FOR VERTICAL ENGINE

[75] Inventors: Yoshihito Fukuoka, Hamamatsu; Toshimasa Morita, Iwata, both of Japan

[73] Assignee: Yamaha Hatsudoki Kabushiki Kaisha, Iwata, Japan

[21] Appl. No.: 170,038

[22] Filed: Dec. 20, 1993

[30] Foreign Application Priority Data

Dec. 18, 1992 [JP] Japan ..... 4-355892

[51] Int. Cl.[6] ..... B63H 21/10

[52] U.S. Cl. ..... 440/88; 123/196 R

[58] Field of Search ..... 440/49, 53, 61, 440/75, 77, 88, 89; 123/195 P, 196 R, 196 A, 196 M, 196 V, 196 W; 184/6.17, 6.18, 18

[56] References Cited

U.S. PATENT DOCUMENTS

| | | | |
|---|---|---|---|
| 5,037,340 | 8/1991 | Shibata | 440/88 |
| 5,049,100 | 9/1991 | Yamamoto et al. | 440/88 |
| 5,163,394 | 11/1992 | Koishikawa et al. | 440/88 |

FOREIGN PATENT DOCUMENTS 332998 2/1991 Japan .

*Primary Examiner*—Stephen Avila
*Attorney, Agent, or Firm*—Knobbe, Martens, Olson & Bear

[57] ABSTRACT

Two embodiments of outboard motors having four-cycle internal combustion engines with the crankshaft of the engine rotating about a vertically extending axis in a crankcase chamber formed at the front of the engine. A main oil gallery extends along the crankcase member and receives oil from an oil filter mounted on the crankcase member at the front of the engine.

8 Claims, 4 Drawing Sheets

OIL SUPPLY SYSTEM FOR VERTICAL ENGINE

BACKGROUND OF THE INVENTION

This invention relates to an oil supply system for a vertical engine, and more particularly, to an improved lubricating system for an outboard motor.

Although two-cycle internal combustion engines are widely employed as the power plants for outboard motors, there is an interest in the application of four-cycle engines for this purpose. The application of a four-cycle engine to an outboard motor presents certain peculiar difficulties. These are caused by the fact that the engine is normally positioned so that its crankshaft rotates about a vertically extending rather than a horizontally extending axis. In addition, it is necessary to provide a lubricant sump and lubricating system for such engines allowing their vertical orientation. In addition, there is the always present difficulty of locating all of the necessary components of the engine in a manner so that those components which require servicing can be easily accessed. The oil filter of such an engine is an element that should be readily accessible, as it is desirable to change the oil filter at frequent or at least regular intervals.

In conjunction with four-cycle engine application for outboard motors, it has been the normal practice to position the oil filter on one side of the cylinder block. However, there are a number of other engine auxiliaries, such as the induction system, exhaust system and ignition system, that are also so located, and this gives rise to problems in ensuring that all components can be easily serviced and yet that the components will not interfere with each other.

Also, it is generally desirable to provide some of the servicing on the outboard motor on the motor while it is still attached to the transom of an associated watercraft. This presents additional difficulties in the location of the various components which should be serviced frequently, or at least regularly.

It is, therefore, a principal object of this invention to provide an improved lubricating system for an outboard motor.

It is another object of this invention to provide an improved lubricating system for an outboard motor embodying a four-stroke internal combustion engine.

It is a yet further object of this invention to provide an improved and simplified oil filter location for such outboard motors in which the oil filter is readily accessible for servicing.

SUMMARY OF THE INVENTION

This invention is adapted to be embodied in an outboard motor that is comprised of a power head comprising an internal combustion engine and a surrounding protective cowling. A drive shaft housing and a lower unit depend from the power head and contain a propulsion device that is driven by the engine. The engine has a crankshaft supported for rotation about a vertically extending axis within a crankcase. A lubrication system is provided for circulating lubricant to the engine, and this includes an oil filter mounted on the crankcase.

DETAILED DESCRIPTION OF THE PREFERRED EMBODIMENTS OF THE INVENTION

Figure 1:
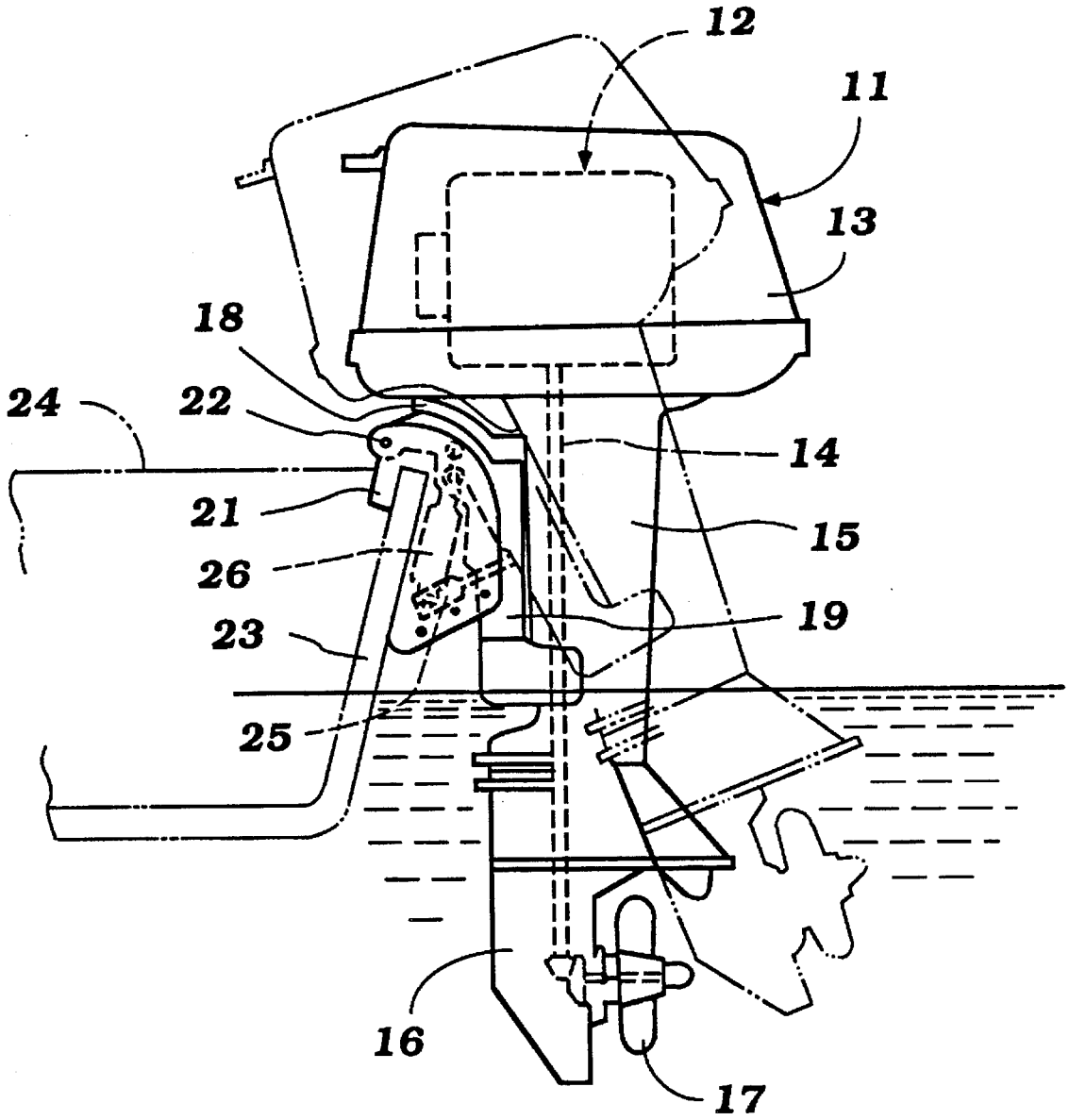
FIG. 1 is a side elevational view of an outboard motor attached to the transom of an associated watercraft, shown partially and in phantom.
Figure 2:
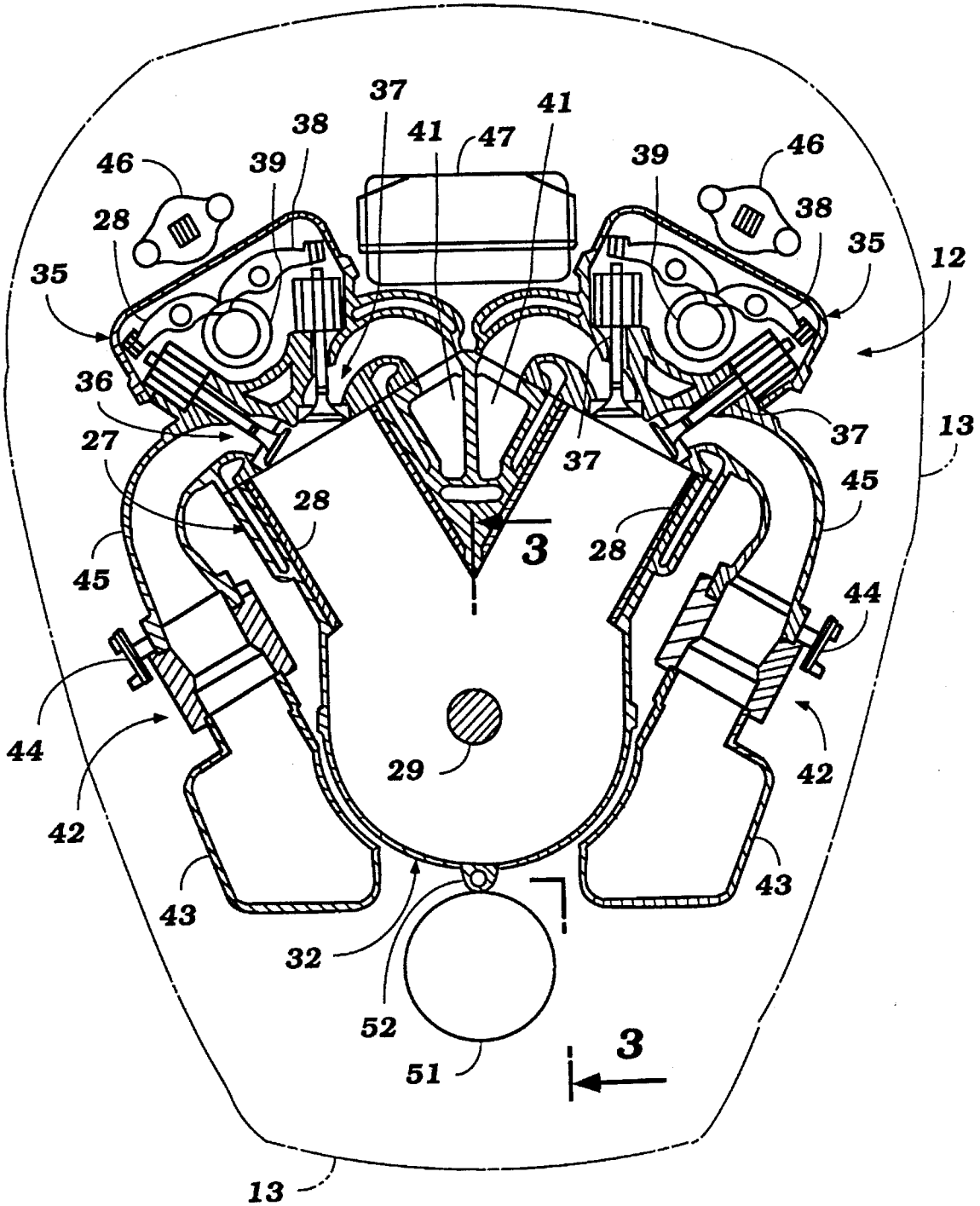
FIG. 2 is an enlarged cross-sectional view taken along a horizontal plane of the power head of the embodiment of FIG. 1, with the protective cowling being shown in phantom.
Figure 3:
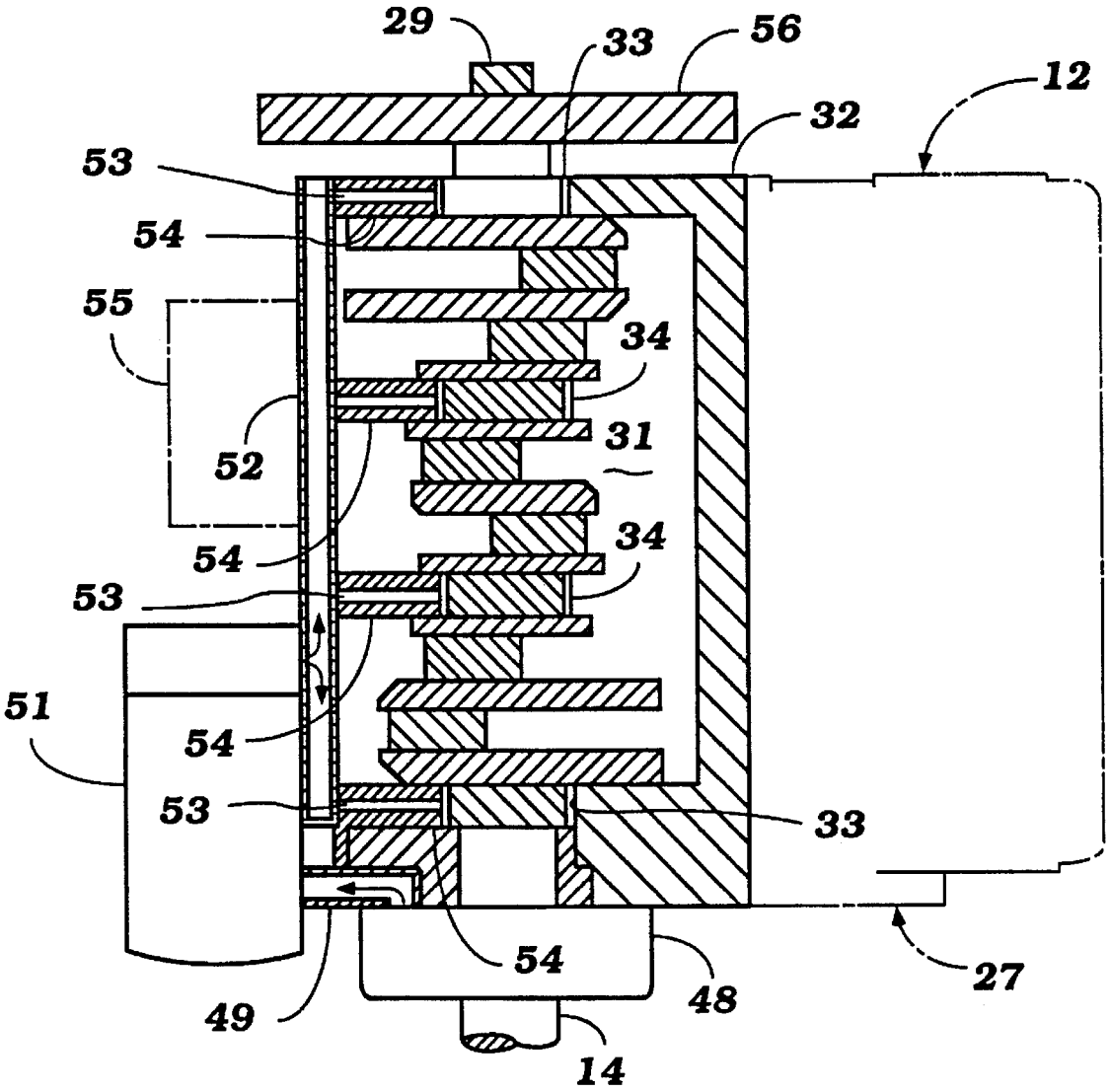
FIG. 3 is a vertical cross-sectional view taken generally along the line 3—3 of FIG. 2.

Referring now in detail to the drawings and initially to FIG. 1, an outboard motor constructed in accordance with an embodiment of the invention is identified generally by the reference numeral 11. The outboard motor 11 is comprised of a power head consisting of an internal combustion engine 12, of a configuration which will be described later by reference to FIGS. 2 and 3, and a surrounding protective cowling 13.

As will be described and as is typical with outboard motor practice, the engine 12 is supported with its crankshaft rotating about a vertically extending axis. This crankshaft is coupled to a drive shaft 14 that is journalled in a drive shaft housing 15 and which depends downwardly into a lower unit 16 wherein it drives a propeller 17 through any form of conventional transmission.

A steering shaft having a tiller 18 affixed to its upper end is affixed to the drive shaft housing 15 and is supported for steering movement within a swivel bracket 19. The steering shaft does not appear in the drawings. The swivel bracket 19 is, in turn, pivotally connected to a clamping bracket 21 by means of a pivot pin 22 for tilt and trim movement of the outboard motor 11. The motor 11 is shown in its fully trimmed-down condition in solid lines in FIG. 1 and is shown in a fully trimmed-up condition in phantom lines. In addition to these positions and those intermediate, the outboard motor 11 may be tilted up to an out-of-the-water position, as is well-known in this art.

The clamping bracket 21 contains a suitable device for affixing the outboard motor 11 to a transom 23 of an associated watercraft, shown partially in phantom and identified by the reference numeral 24. A hydraulic trim cylinder 25 is interposed between the clamping bracket 21 and the swivel bracket 19 for the trim movement of the outboard motor 11. In addition, a tilt cylinder 26 is also interposed between the clamping bracket 21 and the swivel bracket 19 for a full tilt up of the outboard motor 11. This tilt cylinder 26 also includes a shock absorbing mechanism so as to permit the outboard motor 11 to pop up and clear an underwater obstacles when struck with sufficient force, as is well-known in this art.

The construction of the outboard motor 11 as thus far described may be considered to be conventional; and, for that reason, further details of the construction are not believed to be necessary to permit those skilled in the art to practice the invention.

The invention deals primarily with the construction of the engine 12, and specifically the lubricating system therefor. This construction may be best understood by reference to FIGS. 2 and 3.

In the illustrated embodiment, the engine 12 is of the V-type, having six cylinders formed by a cylinder block 27 aligned in two banks of three each. The cylinder bores appear in FIG. 2 and are identified generally by the reference numerals 28, there being three cylinder bores 28 in each cylinder bank. As should be readily apparent to those skilled in the art, and a specific embodiment will be later described, the invention may be employed with in-line engines as well as engine having cylinder banks that are disposed at an angle to each other. Since the invention deals with certain components of the lubricating system for the engine, full details of the engine have not been illustrated, and the pistons, connecting rods, etc. have been deleted in the figures for simplicity.

This mechanism, however, drives a crankshaft 29, which, as has been noted, rotates about a vertically extending axis. The crankshaft 29 is supported for rotation within a crankcase chamber 31 formed by the skirt of the cylinder block 27 and a crankcase member 32 that is affixed in any suitable manner to the cylinder block 27. As may be seen in FIG. 3, the crankshaft 29 has end main bearings 33 and a pair of center main bearings 34 that are formed in any well-known manner and which are formed at least in part by the crankcase member 32 for rotatably journaling the crankshaft 29.

Cylinder head assemblies 35 are affixed to the respective cylinder banks and include intake valves 36 and exhaust valves 37, which are supported in the cylinder head assemblies 35 in a well-known manner. These intake and exhaust valves are operated by rocker arms 38 journalled in the cylinder head assemblies 35 in a known manner and operated by respective cam shafts 39, which are driven by the crankshaft 29, through any suitable type of cam shaft drive. Again, the construction of the cylinder heads and valves forms no part of the invention, and, therefore, further details of this construction are not believed to be necessary to understand the construction and operation of the inventive portions of the engine 12.

The exhaust valves 37 control the flow of exhaust gases to a pair of exhaust manifolds 41, which are formed in the cylinder heads 35 and cylinder blocks 28 in the valley between the cylinder banks. These exhaust manifolds 41 discharge the exhaust gases downwardly into an exhaust system contained within the drive shaft housing 15 and lower unit 16 for discharge of the exhaust gases to the atmosphere in any well-known manner.

An induction system, indicated generally by the reference numeral 42, is provided for supplying a fuel air charge to the individual cylinders of the engine. This induction system includes a pair of air inlet devices 43, each of which draws air from within the protective cowling 13 and delivers it to a throttle body in which throttle valves 44 are provided for controlling the speed of the engine. These throttles bodies communicate with intake manifolds 45 fixed to the respective sides of the cylinder head assemblies 35. A charge former is not shown in the illustrated embodiment, but the engine may be employed with either fuel-injected or carbureted engines, and again this construction is not critical to the invention, and thus a further description of it is not believed to be necessary.

Spark plugs (not shown) are mounted in the cylinder head assemblies 35 and are fired by individual spark coils 46, which are, in turn, operated by an ignition control system, indicated generally by the reference numeral 47 and which is positioned conveniently in the valley between the cylinder banks.

All of the construction of the engine 12 as thus far described may be considered to be conventional, and for that reason further description of the engine is not believed to be necessary to permit those skilled in the art to practice the invention. Any details not specifically disclosed may be considered to be conventional.

The invention deals primarily with certain components of the lubrication system for the engine 12, and these include a lubricant pump 48, which is driven off the lower end of the crankshaft 29 and which may be of any conventional type. This oil pump draws lubricant from a lubricant reservoir, preferably positioned in the upper end of the drive shaft housing 15, and distributes it through a main discharge passage 49 formed in the lower front portion of the crankcase member 32. This delivers lubricant to a full flow oil filter 51, which is mounted on the lower or front side of the crankcase member 32 and at the front of the power head and outboard motor 11. As a result of this location, the oil filter 51 may be readily accessed for servicing by removing the protective cowling 13 and while the outboard motor 11 is still attached to the transom 23 of the watercraft 24.

The oil filter 51 then discharges the lubricant that has been filtered to a main oil gallery 52 formed integrally in the base of the crankcase member 32 and which extends vertically. This main oil gallery 52 is intersected by a plurality of passages 53 formed in the main bearing members 54 of the crankcase member 32. This delivers lubricant under pressure to all of the main bearings 33 and 34. In addition, the passages 53 may also extend upwardly at one or both ends of the engine (upper or lower) for lubricating the valve mechanism contained within the cylinder heads 35. Again, this portion of the lubrication system may be considered to be conventional, and thus further description of it is not believed to be necessary.

If desired, an electric starter 55 may be also mounted on the crankcase member 32 at the upper end thereof above the oil filter 51 for driving a starter gear formed on a flywheel 56 for starting of the engine 12. This starter motor 55 is disposed so that it will be clear of the oil filter 51 so that the oil filter 51 may be easily serviced.

Figure 4:
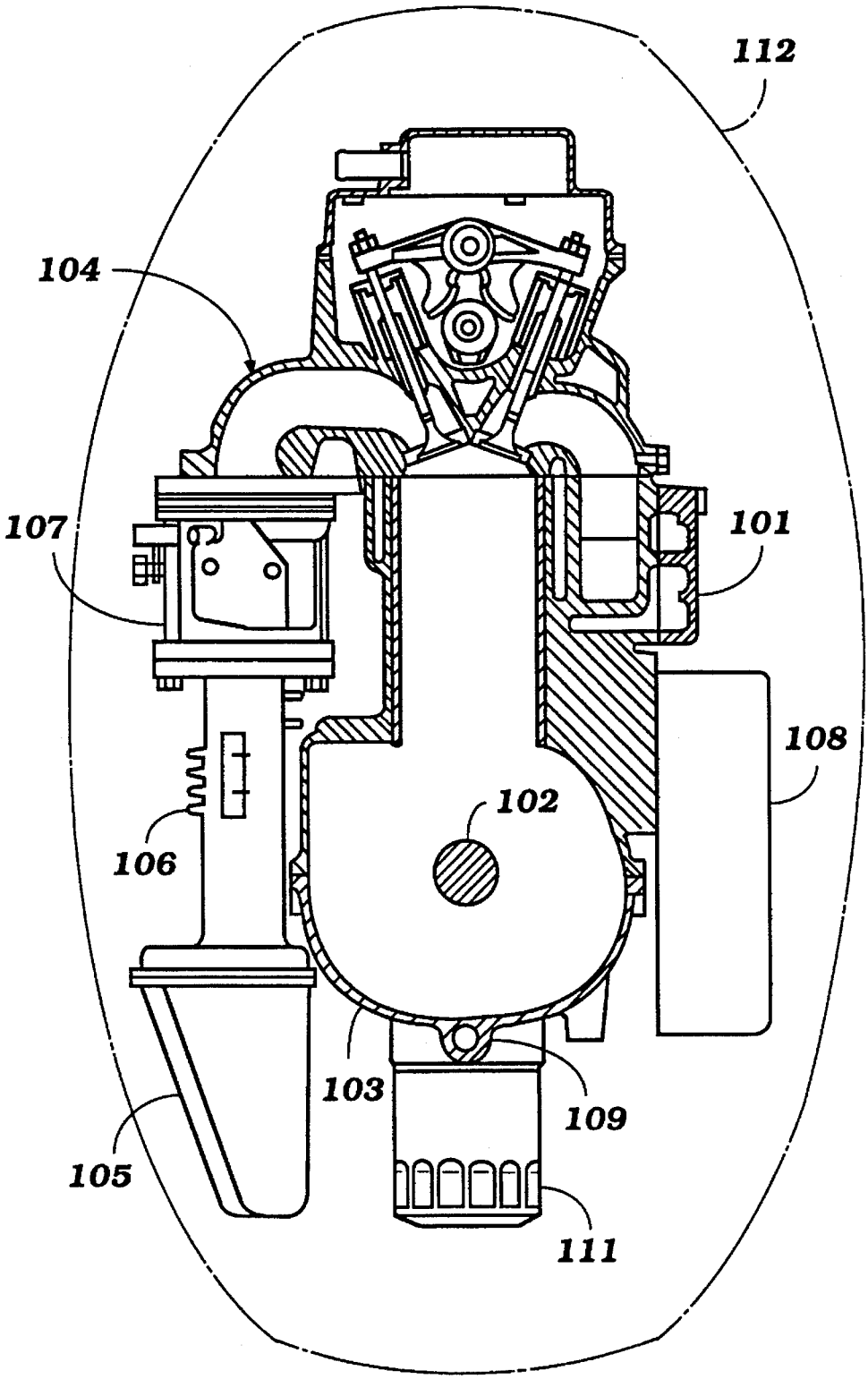
FIG. 4 is a horizontal cross-sectional view, in part similar to FIG. 2, and shows another embodiment of the invention.

As has been noted, the invention does not have limitations as to the type of engine with which it is employed, and FIG. 4 shows another embodiment of the invention as applied to an in-line type of engine.

The components of the engine in this embodiment have also conventional constructions except for the lubrication system, and specifically the oil filter and the way in which it is mounted. Therefore, these components will be described only very summarily and include a cylinder block 101 that rotatably journals a crankshaft 102 for rotation about a vertically extending axis within a crankcase chamber formed by the cylinder block 101 and a crankcase member 103 that is affixed to the cylinder block in a known manner. A cylinder head assembly 104 having intake and exhaust valves and induction and exhaust passages is affixed to the cylinder block 101 in a known manner. The engine includes an induction system including an air inlet device 105, air manifold 106, and charge formers 107, which lie on one side of the cylinder block 101. An ignition system is also provided, and this includes a spark control box 108 disposed at the opposite side of the engine.

The bottom or front side of the crankcase member 103 is provided again with a vertically extending main oil gallery 109 that lubricates the main bearings for the crankshaft 102 and the valve train in a suitable manner. The oil pump is driven in this embodiment like the previously described embodiment, and oil is delivered to the main oil gallery 109 through a full flow cartridge-type oil filter 111 that is positioned so that it extends in a horizontal direction and forwardly of the crankcase member 103 toward the associated watercraft. This oil filter 111 may be conveniently removed for servicing by removal of a protective cowling 112.

It should be readily apparent from the foregoing description that the described embodiments of the invention offer a very effective lubrication system for a four-cycle engine of an outboard motor wherein the oil filter is disposed in a very accessible place and where it will not interfere with other accessories or components of the engine. Of course, the foregoing description is that of preferred embodiments of the invention, and various changes and modifications may be made without departing from the spirit and scope of the invention, as defined by the appended claims.

We claim:

1. An outboard motor comprised of a power head comprised of an internal combustion engine and a surrounding protective cowling, a drive shaft housing and lower unit depending from said power head and containing a propulsion device driven by said engine, said engine having a cylinder block with at least one cylinder bore formed therein and a crankshaft supported for rotation about a vertically extending axis within a crankcase chamber formed by an opening in the end of cylinder block opposite said cylinder bore and a crankcase member affixed to said cylinder block on the side opposite said cylinder bore and closing said opening, and a lubrication system for circulating lubricant to said engine, including an oil filter mounted upon said crankcase member.

2. The outboard motor of claim 1, wherein the crankcase member is disposed at the front of the power head.

3. The outboard motor of claim 2, wherein the oil filter is disposed on the front of the crankcase member.

4. The outboard motor of claim 3, wherein the oil filter extends vertically.

5. The outboard motor of claim 3, wherein the oil filter extends horizontally.

6. The outboard motor of claim 3, wherein the crankcase member is formed with oil passages through which lubricant flows to and from the oil filter.

7. The outboard motor of claim 4, wherein the crankcase member is formed with oil passages through which lubricant flows to and from the oil filter.

8. The outboard motor of claim 5, wherein the crankcase member is formed with oil passages through which lubricant flows to and from the oil filter.

* * * * *